US008328127B2

(12) United States Patent
Ito et al.

(10) Patent No.: US 8,328,127 B2
(45) Date of Patent: Dec. 11, 2012

(54) SPOOL ASSEMBLY

(76) Inventors: Bill Ito, Cobourg (CA); Mark Ito, Cobourg (CA)

( * ) Notice: Subject to any disclaimer, the term of this patent is extended or adjusted under 35 U.S.C. 154(b) by 289 days.

(21) Appl. No.: 12/926,236

(22) Filed: Nov. 4, 2010

(65) Prior Publication Data

US 2011/0108659 A1 May 12, 2011

Related U.S. Application Data

(60) Provisional application No. 61/272,820, filed on Nov. 6, 2009.

(51) Int. Cl.
*B65H 75/14* (2006.01)
*B65H 75/20* (2006.01)

(52) U.S. Cl. ..... 242/608.6; 242/609.1; 242/613.4; 242/614.1; 242/118.6

(58) Field of Classification Search ..... 242/607, 242/608, 608.2, 608.6, 609, 609.1, 613, 613.4, 242/614–614.1, 118.6
See application file for complete search history.

(56) References Cited

U.S. PATENT DOCUMENTS 3,442,464 A * 5/1969 Broos ..... 242/609.1
3,565,363 A * 2/1971 Mizuguchi et al. ..... 242/608.4
4,471,919 A * 9/1984 Leunig ..... 242/608.2
5,415,362 A * 5/1995 Lorenzo ..... 242/608.6
5,967,454 A * 10/1999 Yarnell et al. ..... 242/608.4
6,398,154 B1 * 6/2002 Cox et al. ..... 242/608.2
7,073,746 B2 * 7/2006 Lorenzo Barroso ..... 242/608.5
7,828,242 B2 * 11/2010 Snitselaar ..... 242/608.2
8,272,591 B2 * 9/2012 Baranov et al. ..... 242/608.5
2003/0197087 A9 * 10/2003 Cox et al. ..... 242/608.6
2005/0279877 A1 * 12/2005 Lorenzo Barroso ..... 242/608.5

FOREIGN PATENT DOCUMENTS

GB 2164020 A * 3/1986

* cited by examiner

*Primary Examiner* — William E Dondero
(74) *Attorney, Agent, or Firm* — Arne I. Fors

(57) ABSTRACT

A plastic spool assembly comprising a central barrel and a circular end flange for attachment to each cylindrical end of the barrel, each end flange having a central hub having central opening with an annular ridge formed thereon extending radially inwardly for snap-fitting into and mating with an annular recess of the central barrel for tight-fitting locking engagement, each end flange having a plurality of radial slots for flexing of the end flange. Each barrel end annular recess preferably has a plurality of equispaced teeth extending radially outwardly and the annular ridge in the flange hub opening has a plurality of equispaced teeth extending radially inwardly therefrom for interlocking with and engaging the teeth of the annular recess for preventing angular circumferential movement of the flanges. The central barrel preferably is comprised of a pair of molded mirror-shaped plastic halves with alignment tabs and may be joined by a plastic hinge. Each end flange may have a first circular rib formed on a flange outer face between the central hub and a peripheral rim joining outer ends of the radial slots. Each end flange may have a second circular rib intermediate the first circular rib and the peripheral rim and joined thereto by the plurality of equispaced spokes.

15 Claims, 7 Drawing Sheets

FIG.7
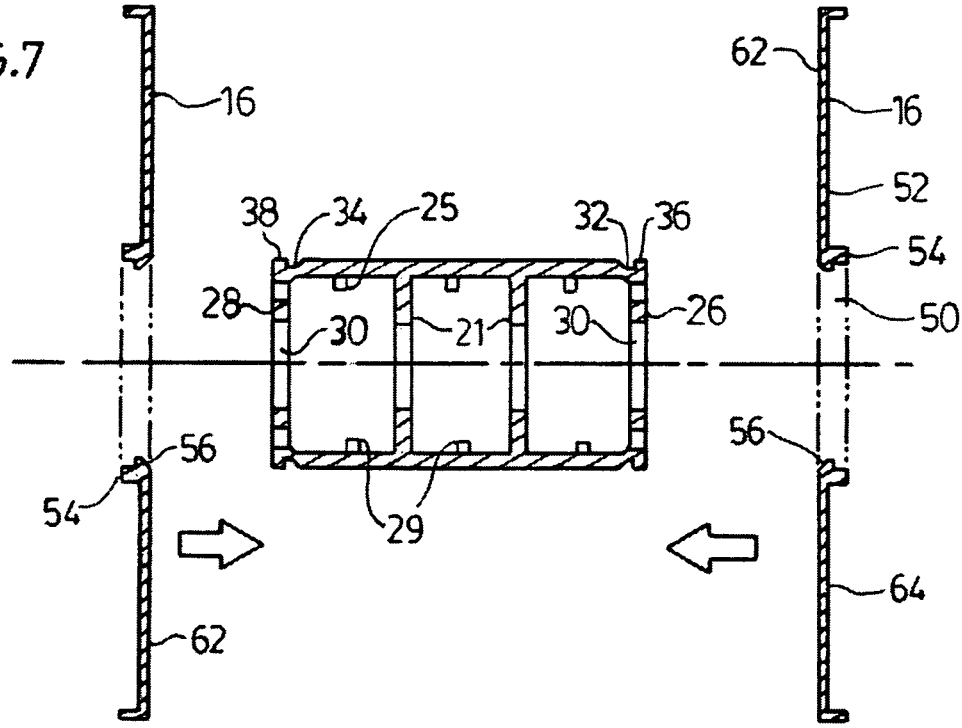
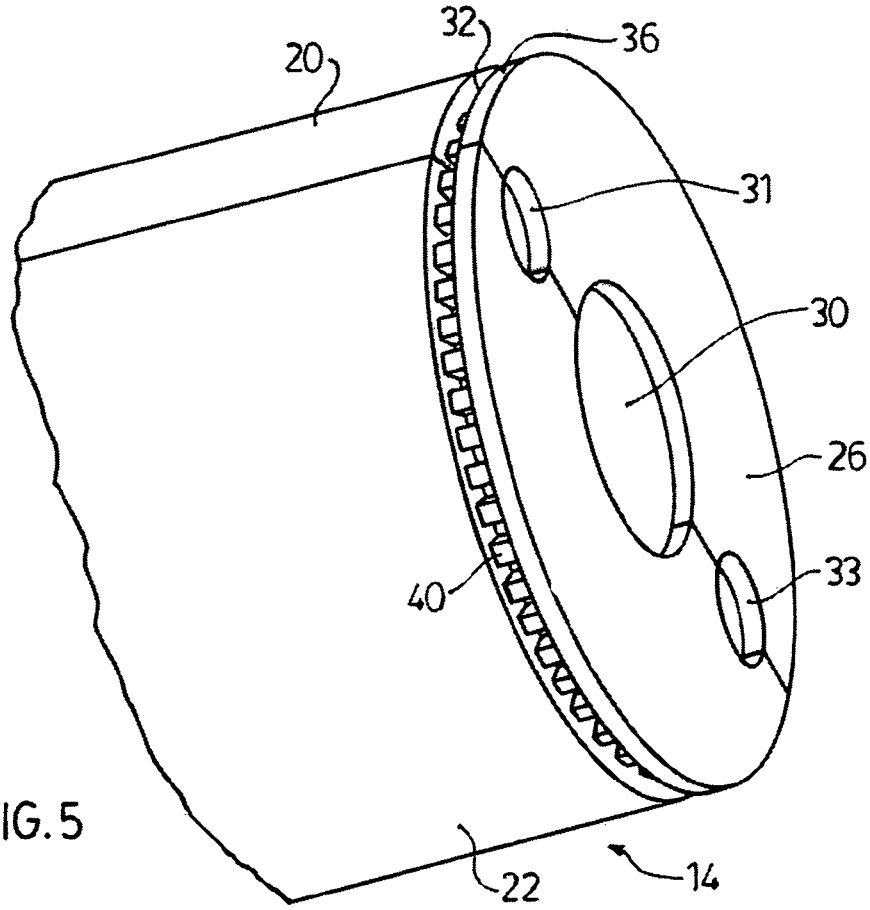
FIG.5

SPOOL ASSEMBLY

BACKGROUND OF THE INVENTION (i) Field of the Invention

This invention relates to spools for receiving wire, cord, string and the like stranded materials bound thereon and, more particularly, relates to a spool assembled from three moulded plastic components.

(ii) Description of the Related Art

Conventional spools and reels for drawing or winding cordage such as wire, cord, string, cable and the like stranded materials onto the spool or reel are fabricated from wood, metal and plastic materials. The spools must be able to transfer cordage onto the barrel between the end flanges of the spools during winding of the cordage onto the spool and must have sufficient strength to not only support the load of the cordage but also to avoid failure of the flanges when transporting and loading and unloading loaded spools.

Plastic spools have become preferred over wood or metal spools because plastic material typically is less expensive than metal or wood material and the plastic spools can be molded from polyolefin polymers which are environmentally friendly in that the plastic materials are thermoplastic and usually can be recycled.

A disadvantage of plastic spools, however, resides in the difficulty of assembling the plastic end flanges to the ends of the plastic barrels. Unless molded integrally with the barrel, or glued to the barrel, the flanges are not fastened to the barrel and are prone to slip circumferentially with respect to the barrel. Each flange has a central arbour hole for receiving a shaft through the hollow barrel for rotating the spool during loading and unloading of cordage by winding of the spool by engagement with drive holes formed in the flanges. Slippage of the flanges on the barrel impedes winding of cordage on the spools during loading.

It is a principal object of the invention therefore to provide a spool assembly having the flanges locked or keyed onto the barrel to prevent circumferential slippage of the flanges on the barrel.

It is another object of the present invention to provide a simple and inexpensive plastic spool assembly which, can be readily manufactured, transported in a compact knock down form and assembled when required for use.

SUMMARY OF THE INVENTION

In its broad aspect, the plastic spool assembly of the invention for receiving and supporting a strand of cordage comprises a central barrel having opposite cylindrical ends with an annular recess extending about each barrel end perimeter in proximity to each end, and a circular end flange for attachment to each cylindrical end of the barrel, each end flange having a central hub defining a central opening for receiving the cylindrical end of the barrel in tight-fitting engagement, said central hub opening having an annular ridge formed thereon extending radially inwardly for snap-fitting into and mating with the annular recess of the central barrel for tight-fitting locking engagement therewith, each end flange having a plurality of radial slots, preferably equispaced and diametrically opposed, formed about the central hub opening for flexing of the end flange adjacent the central hub opening for snap-fitting of an end flange onto the central barrel and into the annular recess at each end of the barrel.

The annular recess extending about each end perimeter of the central barrel preferably has a plurality of equispaced teeth extending outwardly therefrom and the inwardly extending annular ridge formed in the central hub opening of each flange has a plurality of mating equispaced teeth extending inwardly therefrom about the central hub opening for interlocking with and engaging the teeth of the annular recess of the central barrel for preventing angular cirumferential movement or slippage of the end flanges on the central barrel.

The central barrel preferably is moulded from a polymeric plastic as a pair of mirror-image plastic halves, preferably joined by a plastic hinge, for assembly into a cylindrical barrel at the time of assembly of the spool.

The central barrel and end flanges of the spool assembly of the invention preferably are formed of a moulded thermoplastic polymer such as polyethylene, polypropylene or polyvinyl chloride.

Each end flange has an inner face and an outer face and preferably a first circular rib formed on the flange outer face between the central hub and a peripheral rim joining outer ends of the radial slots. Radial ribs are formed on the outer flange face on each side of the radial slots between the hub and the first circular rib. A plurality of equispaced spokes interconnect the peripheral rim to the first circular rib. The plurality of spokes are disposed at an angle of about 45° to the peripheral rim and to the circular rib. Each end flange may have a second circular rib intermediate the first circular rib and the peripheral rim and joined thereto by the plurality of equispaced spokes. The plurality of spokes joining the second circular rib to the first circular rib and to the peripheral rim may meet at nodes formed in the second circular rib or the plurality of spokes joining the second circular rib to the first circular rib and to the peripheral rim are angularly offset.

BRIEF DESCRIPTION OF THE DRAWINGS

The spool assembly of the invention will now be described with reference to the accompanying drawings, in which:

FIG. 5 is a perspective view of an end of an assembled barrel;

FIG. 7 is a vertical section of opposed end flanges and barrel prior to connection of the flanges to the barrel;

DESCRIPTION OF THE PREFERRED EMBODIMENT

Figure 1:
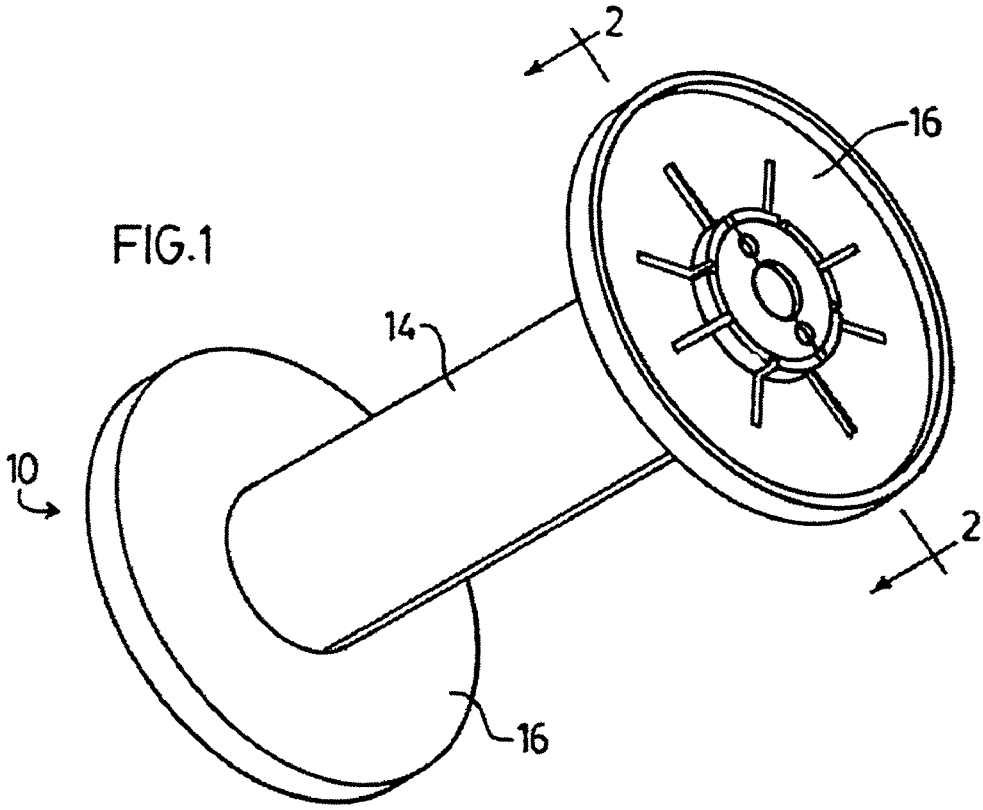
FIG. 1 is a perspective view of an embodiment of the assembled spool.
Figure 2:
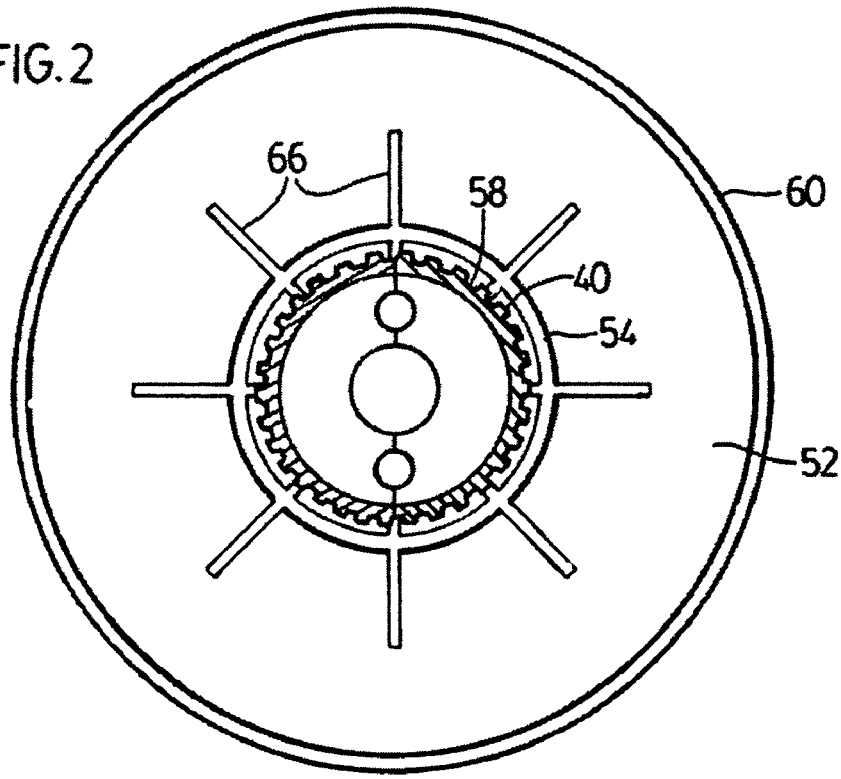
FIG. 2 is an end section taken along line 2-2 of the assembled spool shown in FIG. 1.

An embodiment of the spool 10 of the invention as depicted in FIG. 1 of the drawings for holding long strands of cordage such as wire, cord or cable comprises a rigid, cylindrical barrel or tube 14 and a pair of opposed identical end flanges 16.

In the preferred embodiment of the invention, the central barrel and the end flanges are molded from a rigid thermoplastic material such as a high impact moulded olemeric polymer typified by polyethylene, polypropylene and polyvinyl chloride which can be readily injection molded.

Figure 3:
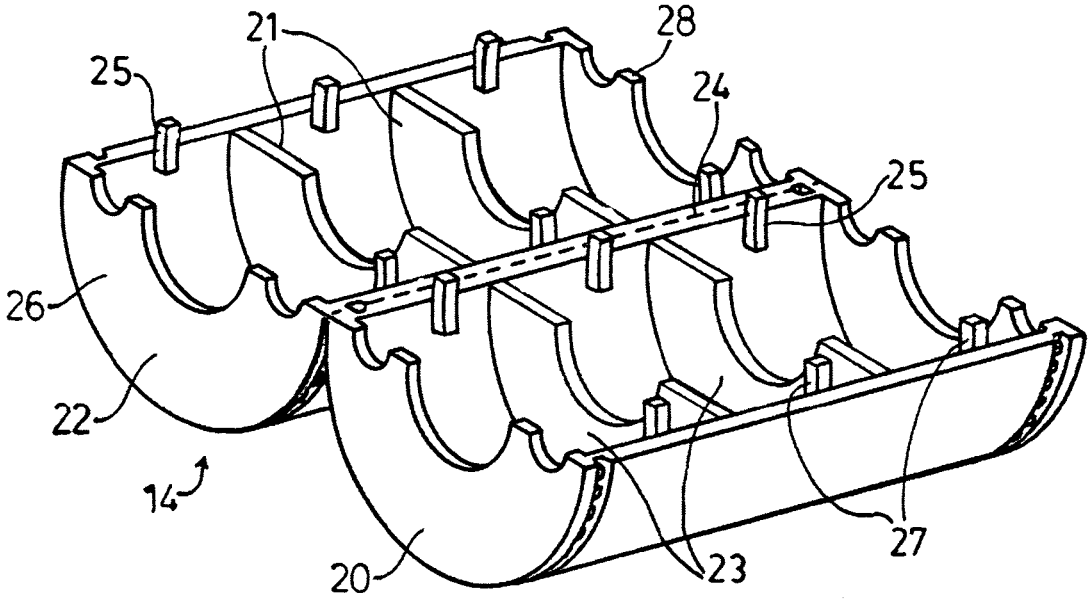
FIG. 3 is a perspective view of an opened hinged embodiment of barrel showing partition reinforcement and alignment tabs.
Figure 4:
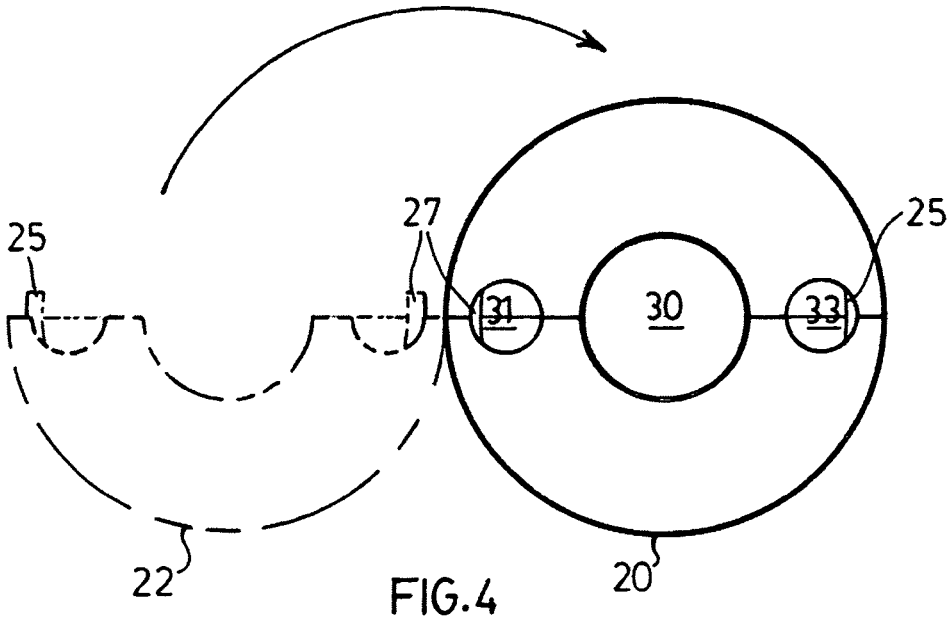
FIG. 4 is an end view of the barrel shown in FIG. 3 showing assembly of the barrel halves.

Barrel 14, shown most clearly in FIGS. 3 and 4, is a right cylinder preferably molded in two parts 20, 22 which may be joined by a hinge 24 for ease of transport and assembly by simple pivotal movement about hinge 24, as depicted in FIG. 4.

Each barrel part interior preferably has at least one transverse partition or rib 21 for reinforcement, opposed to a corresponding partition or rib 23 formed on the other part. Alignment tabs 25 formed on the interior along one edge 27 of parts 20, 22 are axially offset from alignment tabs 29 formed on the interior along the other edge 31 of the parts, as shown most clearly in FIGS. 3, 4 and 7. The opposed sides of tabs 25, 29 abut each other during assembly, particularly if no hinge 24 is present, to axially align the two parts 20, 22. During winding of cordage on the spools, the opposed partitions 21, 23 and abutting tabs 25, 27 resist torque loads imposed on the barrels which otherwise might deform and split the barrels.

Figure 6:
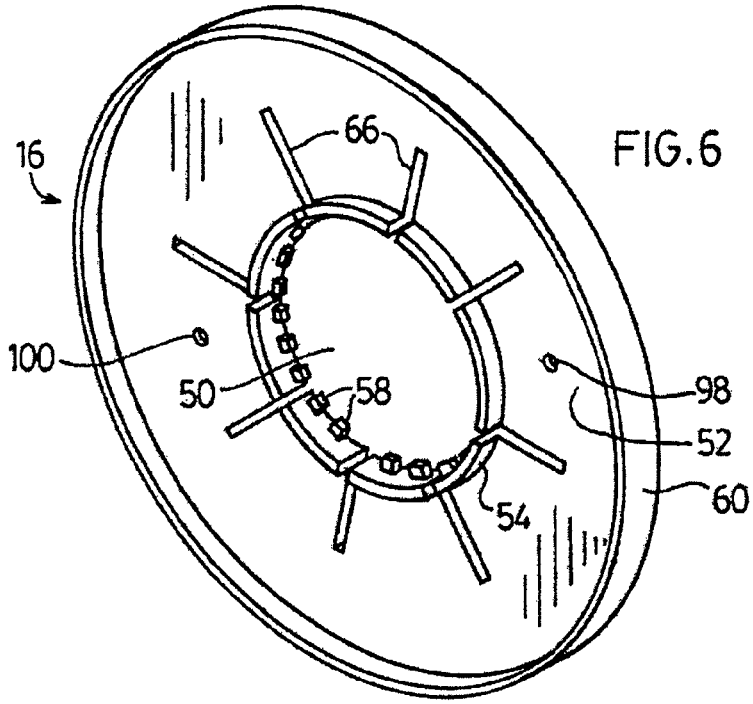
FIG. 6 is a perspective view of an end flange.

The opposite ends 26, 28 of barrel 14 have a central opening 30 defining an arbour hole for receiving an arbour during winding and unwinding of cordage, shown most clearly in FIGS. 5-7. Drive holes 31, 33 outboard of central hole 30 diametric to each other are adapted to receive drive projections from a winding mechanism which rotates the spool to wind cordage tightly thereon.

Annular grooves or recesses 32, 34 extend about opposite ends of barrel 14 in proximity to the barrel ends defining end ridges 36, 38 extending radially outwardly. A plurality of equispaced teeth 40 are formed in annular recesses 32, 34 at least partially around recesses 32, 34 extending radially outwardly for reasons which will become apparent as the description proceeds.

Flanges 16 shown most clearly in FIGS. 2 and 6-9 have a central hub opening 50 with an annular shoulder 54 having an inwardly extending tapered annular ridge 56 with equispaced teeth 58 extending radially inwardly.

Figure 10:
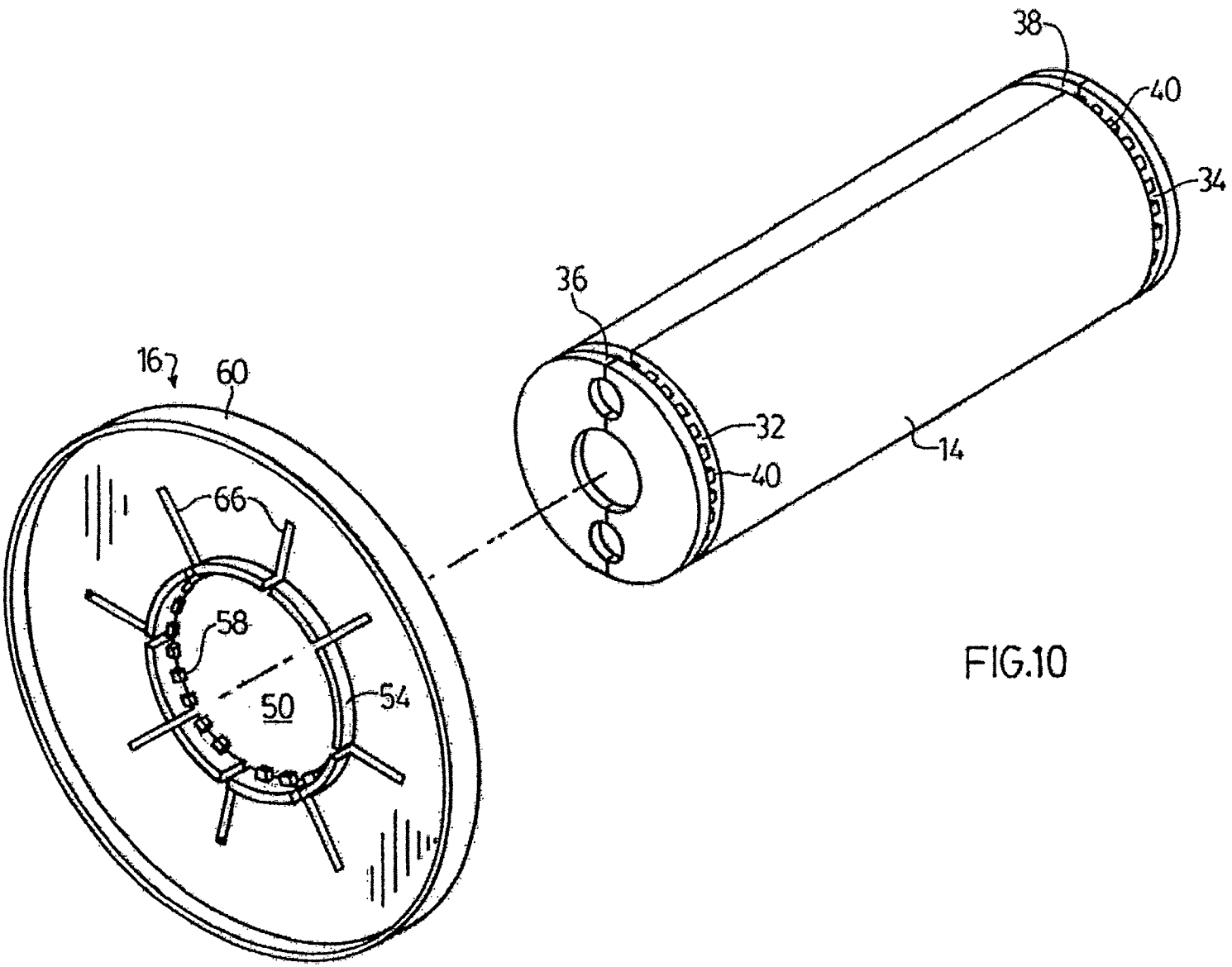
FIG. 10 is an exploded perspective view indicating interengaging teeth formed on the barrel and the flange central opening.

Flange web 52 connects central hub shoulder 54 to peripheral rim shoulder 60. The inner surface 62 of the flange web 52 is smooth to facilitate winding and unwinding of cordage contents, while the outer surface 64 preferably has radial and/or circumferential ridges and the rim shoulder 60 for structural strength, as depicted in FIGS. 10, 11 and 12, to be discussed.

Figure 8:
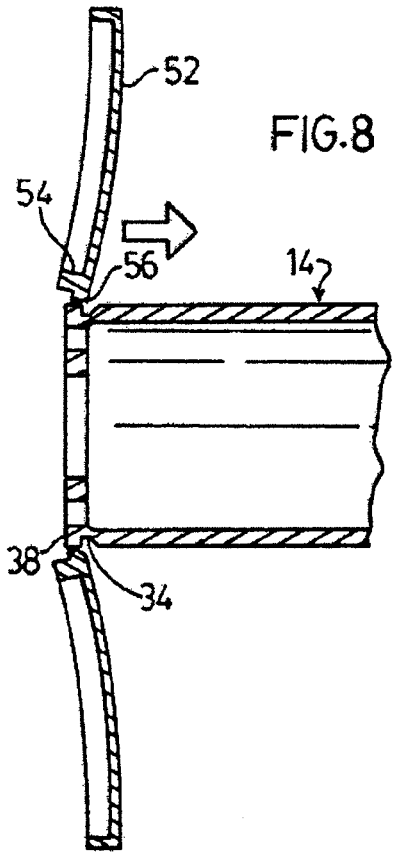
FIG. 8 is a vertical section indicating snap-fitting of an end flange on the barrel.
Figure 9:
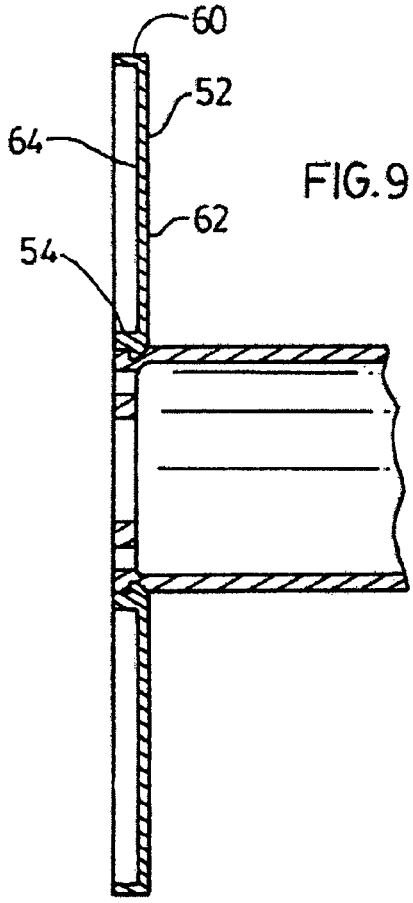
FIG. 9 is a vertical section showing completion of mounting and locking of the flange on the barrel.

Flange web 52 has a plurality of radial slits 66 formed therein extending from hub shoulder 54 about one-half the distance to rim shoulder 60. Slits 66 preferably are equispaced and diametrically opposed in pairs to permit flexing of central hub shoulder 54 during assembly of flanges 16 on core barrel 14, as depicted in FIGS. 7, 8 and 9. Tapered annular ridge 56 flexs outwardly to slip over end ridges 36, 38 and snap-fit inwardly into annular recesses 32, 34 to be locked therein from outward axial pressure. Teeth 58 formed in ridges 36, 38 mate with and engage teeth 40 formed in recesses 32, 34 to prevent angular circumferential movement or slippage of the end flanges on the barrel.

Figure 11:
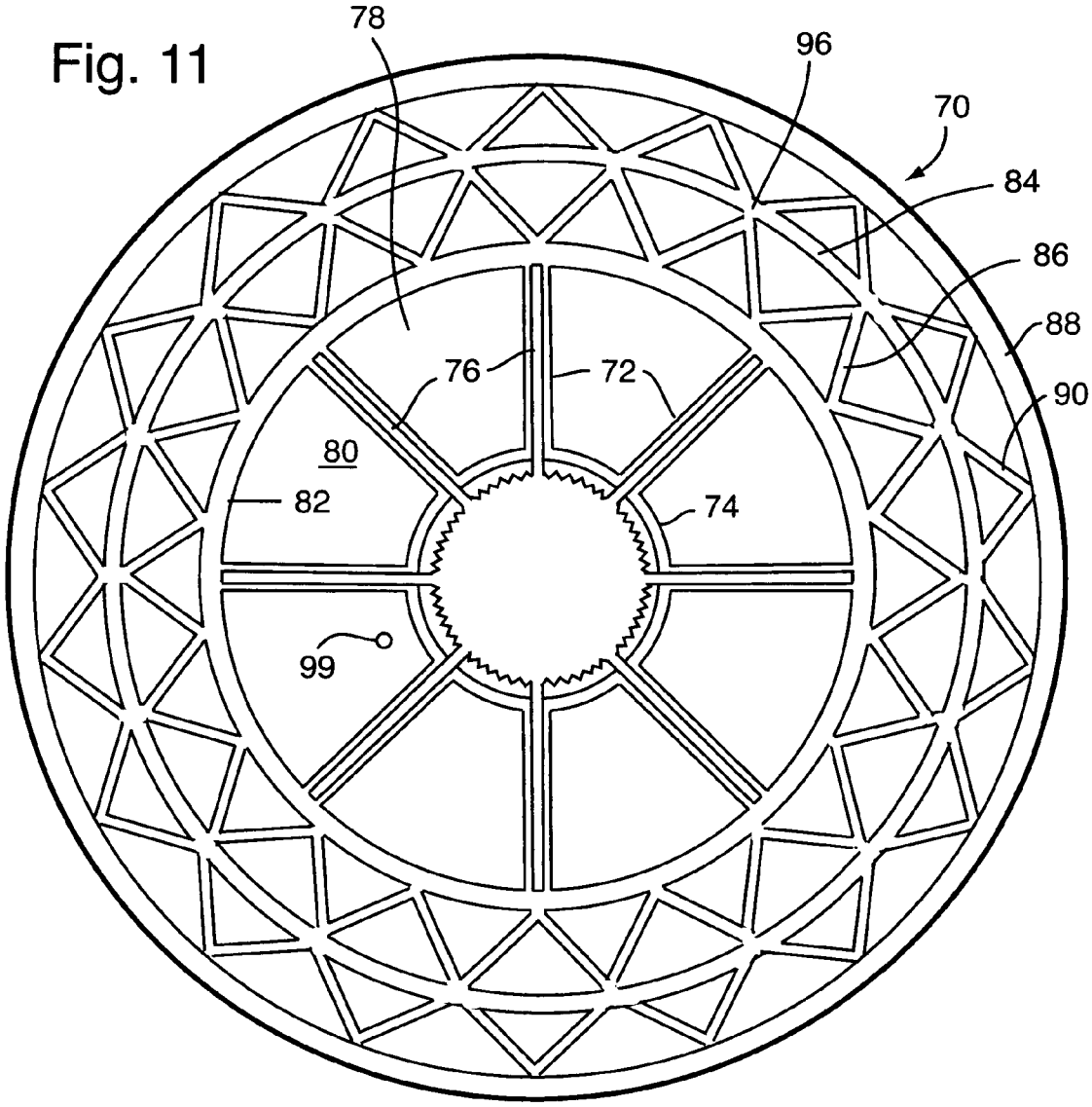
FIG. 11 is a plan view of another embodiment of end flange.
Figure 12:
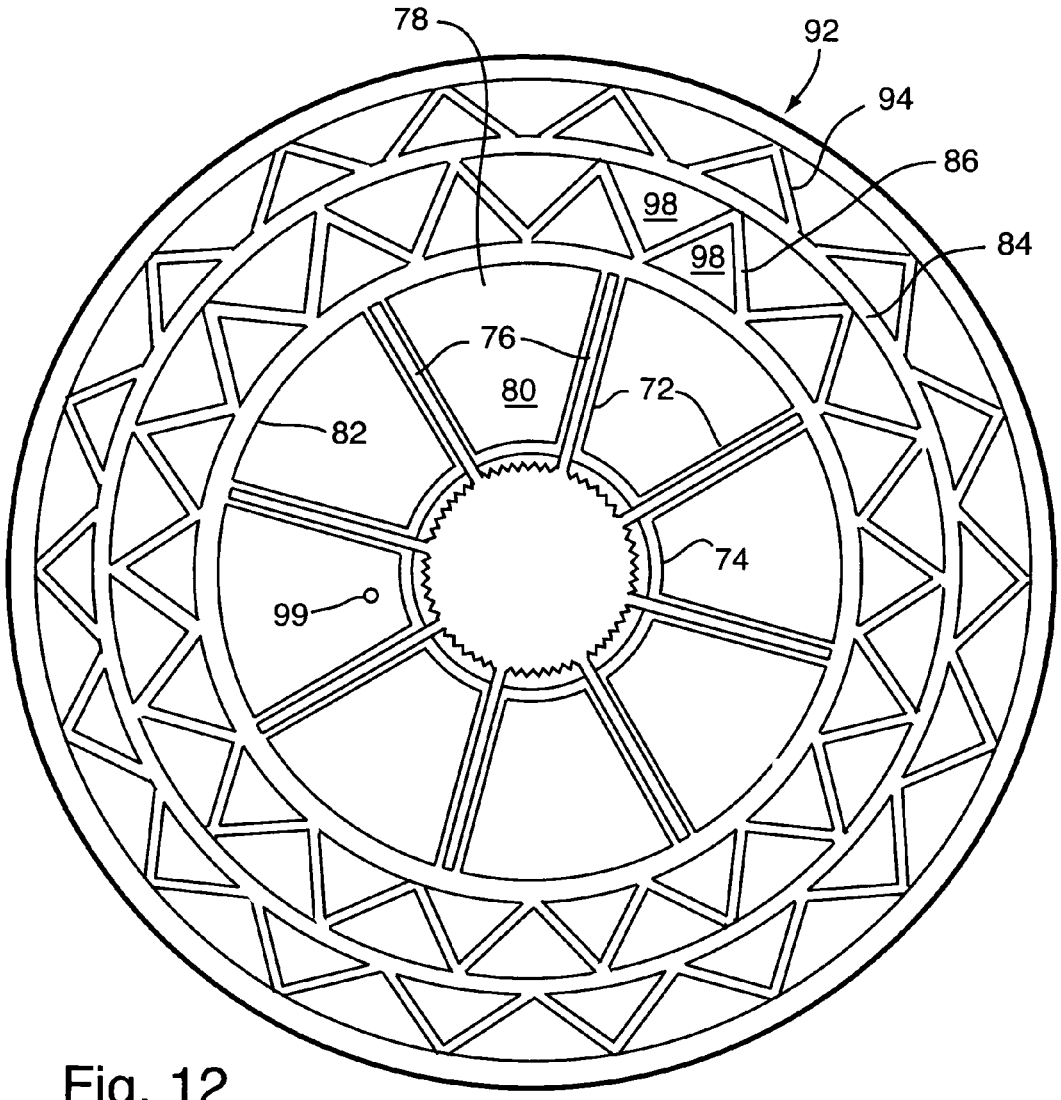
FIG. 12 is a plan view of a further embodiment of end flange.

With reference now to FIGS. 11 and 12, FIG. 11 depicts an end flange 70 having radial ribs 72 extending from hub shoulder 74 to the end of each radial slit 76 on each side thereof on the outer face 78 of flange web 80. Circular rib 82 on outer face 78 intersects the outer ends of ribs 72, at the middle of flange web 80. Circular rib 82 is joined to an intermediate circular rib 84 by a plurality of equispaced spokes 86 disposed at an angle of about 45° sub-tended between ribs 82 and 84. Intermediate circular rib 84 is joined to peripheral rim 88 by a second set of a plurality of equispaced spokes 90 again disposed at an angle of about 45° sub-tended between rib 84 and rim 88. Outer set of spokes 90 is aligned conterminous with the inner set of spokes 86 whereby the spokes are joined at common nodes 96.

FIG. 12 depicts an end flange 92 essentially the same as end flange 70 but with an outer set of spokes 94 angularly offset from the inner set of spokes 86. The web material of the flange preferably fills spaces 98 between spokes 86 from circular rib 82 to intermediate rib 84.

The flange embodiments shown in FIGS. 11 and 12 provide added strength, stiffness and toughness across the flange diameter from the hub to the rim to restrain outward axial loading of cordage, particularly caused by potential damage to the flanges by impact during handling such as during loading and transportation and by falls. The outer rim portion of the flanges will better absorb shock and will flex during impact to help retain the integrity of the hub connection of the flanges to the barrel and prevent axial separation of a flange from the barrel.

Flanges 16, 70 and 92 have start holes 99 formed therein adjacent the central hub for receiving an end of the cordage to be wound on the spool as the spool is rotated about an arbour and one or more finish holes 100 in proximity to the rim. The embodiments of FIGS. 11 and 12 would make use of the spaces between the intermediate circumferential rib and rim as a finish hole.

It will be understood that other embodiments and examples of the invention will be readily apparent to a person skilled in the art, the scope and purview of the invention being defined in the appended claims.

The invention claimed is:

1. A plastic spool assembly for receiving and supporting a strand of cordage comprising a central barrel having opposite cylindrical ends with an annular recess extending about each barrel end perimeter in proximity to each end, and a circular end flange for attachment to each cylindrical end of the barrel, each end flange having a central hub defining a central opening for receiving the cylindrical end of the barrel in tight-fitting engagement, said central hub opening having an annular ridge formed thereon extending radially inwardly for snap-fitting into and mating with the annular recess of the central barrel for tight-fitting locking engagement therewith, each end flange having a plurality of radial slots formed about the central hub opening for flexing of the end flange adjacent the central hub opening for snap-fitting of an end flange onto the central barrel in the annular recess at each end of the barrel.

2. A spool assembly as claimed in claim 1, in which the radial slots are equispaced about the central hub opening in diametrically-opposed pairs.

3. A spool assembly as claimed in claim 2, in which the central barrel and end flanges are formed of a moldable olemeric polymer typified by polyethylene, polypropylene and polyvinyl chloride.

4. A spool assembly as claimed in claim 3, in which each barrel end annular recess has a plurality of equispaced teeth extending radially outwardly therefrom about each barrel end perimeter and the annular ridge formed in the flange hub opening has a plurality of equispaced teeth extending radially inwardly therefrom about the central hub opening adjacent the annular ridge for interlocking with and engaging the teeth of the annular recess for preventing angular circumferential movement of the flanges on the central barrel.

5. A spool assembly as claimed in claim 4, in which the central barrel is comprised of a pair of molded mirror-shaped plastic halves.

6. A spool assembly as claimed in claim 5, in which the pair of molded mirror-image plastic halves are joined by a plastic hinge.

7. A plastic spool assembly as claimed in any one of claim 5, in which each end flange has an inner face and an outer face and a first circular rib formed on the flange outer face between the central hub and a peripheral rim joining outer ends of the radial slots.

8. A plastic spool assembly as claimed in claim 7, in which a plurality of equispaced spokes interconnect the peripheral rim to the first circular rib.

9. A plastic spool assembly as claimed in claim 8, in which the plurality of spokes are disposed at an angle of about 45° to the peripheral rim and to the circular rib.

10. A plastic spool assembly as claimed in claim 9, in which each end flange has a second circular rib intermediate the first circular rib and the peripheral rim and joined thereto by the plurality of equispaced spokes.

11. A plastic spool assembly as claimed in claim 10, in which the plurality of spokes joining the second circular rib to the first circular rib and to the peripheral rim meet at nodes formed in the second circular rib.

12. A plastic spool assembly as claimed in claim 10, in which the plurality of spokes joining the second circular rib to the first circular rib and to the peripheral rim are angularly offset.

13. A plastic spool assembly as claimed in claim 7, in which radial ribs are formed on the outer flange face on each side of the radial slots between the hub and the first circular rib.

14. A spool assembly as claimed in claim 5, in which each barrel molded half has at least one transverse reinforcing interior rib.

15. A spool assembly as claimed in claim 14, in which each barrel molded half has a plurality of spaced-apart first upstanding tabs formed on an interior side edge thereof, and a plurality of spaced-apart second upstanding tabs formed on the opposite interior side edge axially offset from the first upstanding tabs, whereby sides of the first tabs axially abut sides of the second tabs during and after assembly of the barrel halves.

* * * * *